United States Patent [19]

Eason

[11] 4,169,871

[45] Oct. 2, 1979

[54] STAGED CARBURETOR

[75] Inventor: Steven P. Eason, Arnold, Mo.

[73] Assignee: ACF Industries, Inc., New York, N.Y.

[21] Appl. No.: 950,854

[22] Filed: Oct. 12, 1978

[51] Int. Cl.[2] ..... F02M 11/04

[52] U.S. Cl. ..... 261/23 A; 261/41 C

[58] Field of Search ..... 261/23 A, 41 C

[56] References Cited

U.S. PATENT DOCUMENTS

| | | | |
|---|---|---|---|
| 1,623,750 | 4/1927 | Pingree | 261/41 C |
| 2,822,155 | 2/1958 | Roder | 261/41 C |
| 3,003,488 | 10/1961 | Carlson | 261/41 C |
| 3,263,972 | 8/1966 | Braun et al. | 261/52 |

FOREIGN PATENT DOCUMENTS

| | | | |
|---|---|---|---|
| 729422 | 5/1955 | United Kingdom | 261/41 C |

*Primary Examiner*—Tim R. Miles

*Attorney, Agent, or Firm*—J. Joseph Muller

[57] ABSTRACT

A staged multi-barrel carburetor (C) has two air induction passages (P) and first and second throttle valves (T1,T2) one of which is positioned in each of the respective induction passages. The first throttle valve (T1) is operable to open prior to the second throttle valve (T2) opening, and a countershaft (CS) is interconnected with the first throttle valve for rotation therewith as it opens and closes. The countershaft is interconnected (1) with the second throttle valve to open it as the first throttle valve opens, but not until the first throttle valve has opened to a predetermined open position (15). Opening movement of the second throttle valve, after the first throttle valve has opened to its predetermined open position, is delayed (21) if engine vacuum exceeds a predetermined level thereby to prevent lags in engine performance which may occur during engine acceleration.

7 Claims, 2 Drawing Figures

STAGED CARBURETOR

BACKGROUND OF THE INVENTION

This invention relates to staged multi-barrel carburetors and, more particularly, to such carburetors in which staging or opening of the secondary side of the carburetor is delayed if engine vacuum level is too great.

In attempting to design carburetors for use on the smaller four and six-cylinder engines to be installed in many newly designed automobiles, staged carburetors, and particularly staged two-barrel carburetors, are being seriously considered. One problem encountered with staged carburetors is the creation of engine lag, that is, a momentary noticeable fall off in engine performance, when carburetor staging (transfer from one-barrel to two-barrel operation) occurs. It has been experimentally found that downsizing the carburetor (making it smaller) will, in some circumstances, eliminate this problem. However, this may effect engine performance at other operating conditions and may therefore not always be possible. Further, downsizing may not always be possible and, therefore, a solution other than downsizing is needed.

SUMMARY OF THE INVENTION

Among the several objects of the present invention may be noted the provision of an improvement in a staged multibarrel carburetor by which engine lag that otherwise would occur at staging of the carburetor is prevented; the provision of such an improvement in which engine vacuum level is sensed and if it exceeds a predetermined value at staging opening of the secondary side of the carburetor is delayed; and the provision of such an improvement in which opening of the secondary side of the carburetor is delayed as long as the engine vacuum level exceeds the predetermined value.

Briefly, a staged multi-barrel carburetor for an internal combustion engine has at least two air induction passages and first and second throttle valves one of which is positioned in each of the respective induction passages. Each throttle valve is movable between a closed and an open position and the first throttle valve is operable to open prior to the second throttle valve opening. A countershaft is interconnected with the first throttle valve for rotation therewith as it opens and closes. An improvement comprises means interconnecting the countershaft with the second throttle valve to open the second throttle valve as the first throttle valve opens and means carried by the countershaft for producing movement of the interconnecting means to open the second throttle valve after the first throttle valve has opened to a predetermined open position. Means responsive to the vacuum in the engine delays opening movement of the second throttle valve after the first throttle valve has opened to its predetermined open position if engine vacuum exceeds a predetermined level thereby to prevent lags in engine performance which may occur during engine acceleration. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
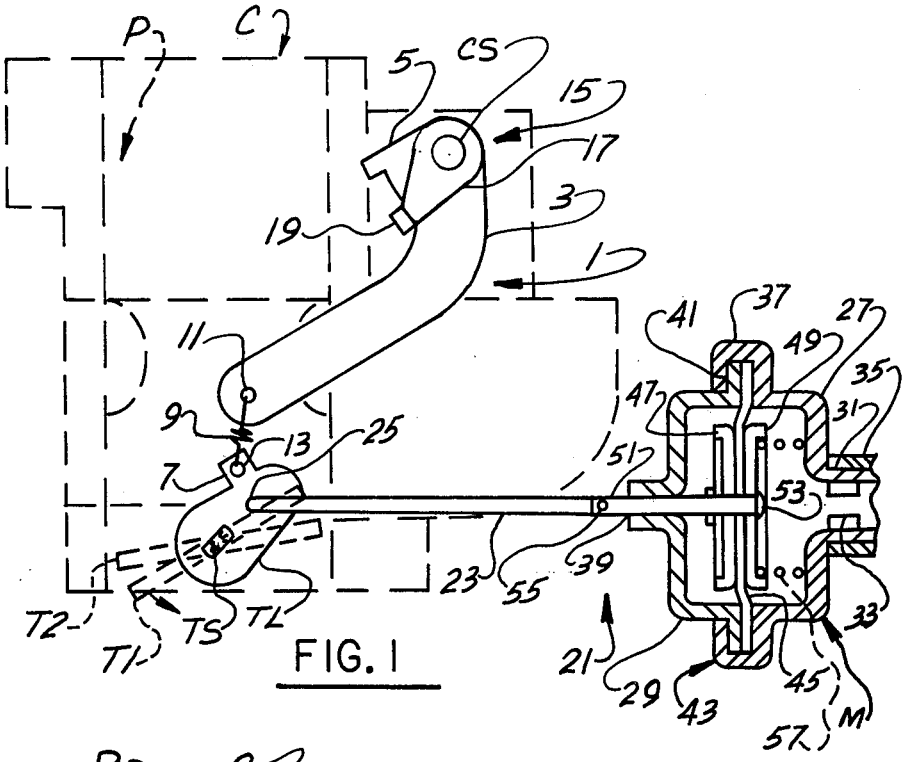
FIGS. 1 and 2 are side elevational views of a staged carburetor, partly in section, illustrating operation of the present invention to delay opening of the secondary side of the carburetor, at staging, if engine vacuum level exceeds a predetermined level.

Referring to the drawings, a staged multi-barrel carburator C for an internal combustion engine (not shown) has two induction passages, one of which is indicated P in the drawings. A first throttle valve T1 is positioned in the induction passage not shown and a second throttle valve T2 is positioned in induction passage P. As is well known in the art, throttle valves T1 and T2 are butterfly valves and are mounted on throttle shafts such as a shaft TS on which the second throttle valve is mounted. A throttle lever TL is mounted on one end (the outer end) of throttle shaft TS. Both throttle valves are movable between a closed and an open position and throttle valve T1 is operable to open prior to throttle valve T2. This is the condition shown in FIG. 1. Staging of carburetor C occurs when throttle valve T2 opens and it is at this point that engine lag, i.e. a fall-off in engine performance, occurs. Throttle valve T1 is interconnected with a countershaft CS for the countershaft to rotate as the first throttle valve opens and closes. Linkages interconnecting the first throttle valve with the countershaft are well known in the art.

The improvement of the present invention comprises means, generally indicated 1, interconnecting the countershaft with throttle valve T2 to open the second throttle valve as the first throttle valve opens. Means 1 includes a loose lever 3 one end, the upper end, of which is carried by countershaft CS. The loose lever has a rearwardly projecting tang 5 and the lower end of the lever curves rearwardly. The lower end of the loose lever is spaced apart from and is above throttle lever TL. The throttle lever is elongate in shape and has a forward projection. An ear 7 extends upwardly from the projecting portion of the throttle lever. Means 1 further comprises a spring 9 one end of which is received in an opening 11 in the lower end of loose lever 3 and the other end of which is received in an opening 13 in ear 7 of the throttle lever.

A means, generally designated 15 is carried by countershaft CS for producing movement of interconnecting means 1 to open throttle valve T2 after throttle valve T1 has opened to a predetermined open position. Means 15 comprises a fixed lever 17 attached to the countershaft and rotatable therewith. Lever 17 is carried on countershaft CS outboard of loose lever 3 and lever 17 has an inwardly extending arm 19 for contacting tang 5 of loose lever 3 when throttle valve T1 has opened to its predetermined open position. Referring to FIG. 1, throttle valve T1 opens in a counterclockwise direction and this produces clockwise rotation of countershaft CS. When throttle valve T1 reaches its predetermined open position, which is, for example, 55° of opening, arm 19 of lever 17 contacts tang 5 of lever 3 and continued opening of throttle valve T1 produces clockwise rotation of the loose lever. Rotation of the loose lever produces a counterclockwise rotative force on throttle lever TL, via spring 9, and results in opening movement of throttle valve T2.

A means, generally indicated 21, is responsive to the vacuum level in the engine for delaying opening movement of throttle valve T2, after throttle valve T1 has opened to its predetermined open position, if engine vacuum exceeds a predetermined level. Means 21 includes a vacuum motor M and a link 23 operable by the vacuum motor. The forward end of throttle lever TL has an opening 25 and one end of link 23 is captured in this opening. By contacting lever TL, link 23 is able to exert a closing or clockwise rotational force on throttle valve T2 which is a function of engine vacuum level.

Motor M is comprised of first and second housing sections 27 and 29 respectively. Both sections are of one-piece, thin-wall sheet metal construction. Section 27 is cupshaped and has a nipple 31 formed at the base of the cup. A restricted opening or control orifice 33 is formed in the end of the nipple. A hose 35 fits over the nipple and connects vacuum motor M to the intake manifold of the engine. Section 27 further has an outwardly extending annular flange 37. Section 29 is also cup-shaped and has a central opening 39 and an outwardly extending annular rim 41. Motor M is assembled by spinning or crimping flange 37 over rim 41 as indicated at 43. The vacuum motor may be attached to the carburetor by a bracket (not shown).

A flexible diaphragm 45 is annular shaped and is of rubber or a suitable synthetic resin material. The margin of diaphragm 45 is clamped between rim 41 and flange 37 to provide an air tight seal around the margin. The diaphragm is sandwiched between a pair of backing plates 47 and 49 respectively. Plate 49 may provide a seat for a compression spring as will be discussed hereinafter.

A stem 51 projects through opening 39 and a pin 53 secures the stem to the diaphragm assembly. The outer end of the stem is flattened and has an opening 55 in which the other end of link 23 is captured.

Figure 2:
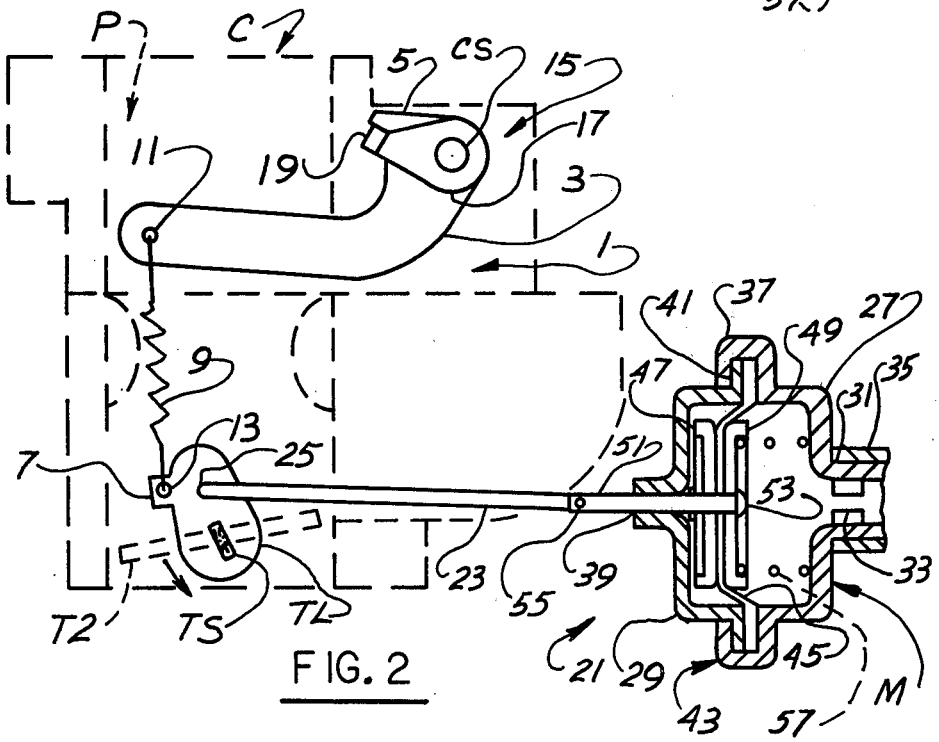

When the engine is running, one side of diaphragm 45 is exposed to engine vacuum and the diaphragm deflects to the right as viewed in the drawings. The amount of deflection is a function of engine vacuum level. Link 23 is drawn to the right by the deflection of the diaphragm to exert a closing force on the throttle lever. As the engine is accelerated, the engine vacuum drops, but opening 33 is so sized that the change is not immediately sensed by the diaphragm. Rather, the diaphragm is exposed to the change a period of time after it occurs. So long as engine vacuum is above the predetermined level, this level being, for example, 4–5 inches Hg, the closing force exerted on the throttle lever by link 23 is sufficient to overcome the opening force exerted on the lever by spring 9 and throttle valve T2 remains closed. When engine vacuum falls below the predetermined value, this is sensed by diaphragm 45 shortly after it occurs and the opening force exerted on the throttle lever will then be sufficient to overcome the closing force and open the second throttle valve as shown in FIG. 2.

It will be understood that the engine vacuum level below which throttle valve T2 opens is controlled by spring 9 and that by controlling the tension of the spring the vacuum level may be higher or lower.

Also, a spring 57 may seat against the base of housing section 27 and backing plate 49 to urge the diaphragm assembly to the left as viewed in the drawings. Spring 57 is not necessary to the operation of the present invention, although it may improve the functioning of the link/diaphragm system. Without the spring, diaphragm 45 is pulled to the left as viewed in the drawings when the opening force exerted on the throttle lever exceeds the closing force exerted thereon by link 23.

It will be further understood that loose lever 3 could be solidly connected to the throttle lever with a wind-up or torsion spring installed on countershaft CS and operating between levers 3 and 17. As before, lever 3 would exert an opening force on the throttle lever when the first throttle valve reached its predetermined open position.

In view of the above, it will be seen that the several objects of the invention are achieved and other advantageous results attained.

As various changes could be made in the above construction without departing from the scope of the invention, it is intended that all matter contained in the above description or shown in the accompanying drawings will be viewed as illustrative and not in a limiting sense.

I claim:

1. In a staged multi-barrel carburetor for an internal combustion engine, the carburetor having at least two air induction passages and first and second throttle valves one of which is positioned in each of the respective induction passages, each throttle valve being movable between a closed and an open position and the first throttle valve being operable to open prior to the second throttle valve opening, and a countershaft interconnected with the first throttle valve for rotation therewith as it opens and closes, the improvement comprising;

means interconnecting the countershaft with the second throttle valve to open the second throttle valve as the first throttle valve opens;

means carried by the countershaft for producing movement of the interconnecting means to open the second throttle valve after the first throttle valve has opened to a predetermined open position; and means responsive to the vacuum in the engine for delaying opening movement of the second throttle valve after the first throttle valve has opened to its predetermined open position if engine vacuum exceeds a predetermined level thereby to prevent lags in engine performance which may occur during engine acceleration.

2. The improvement as set forth in claim 1 wherein the second throttle valve is mounted on a throttle shaft and a throttle lever is attached to one end of the throttle shaft and the interconnecting means comprises a loose lever, one end of which is carried by the countershaft.

3. The improvement as set forth in claim 2 wherein the interconnecting means further comprises a spring, one end of which is attached to the throttle lever and the other end of which is connected to the other end of the loose lever.

4. The improvement as set forth in claim 3 wherein the means carried by the countershaft comprises a fixed lever attached to the countershaft and rotatable therewith, the fixed lever contacting the loose lever when the first throttle valve opens to its predetermined open position to move the loose lever in a direction to exert a second throttle valve opening force on the throttle lever.

5. The improvement as set forth in claim 4 wherein the vacuum responsive means comprises a vacuum motor and a link operable thereby, one end of the link contacting the throttle lever to exert on the second throttle valve a closing force which is a function of engine vacuum level, the closing force exerted on the second throttle valve being sufficient to overcome the opening force exerted thereon when the engine vacuum level exceeds the predetermined level.

6. The improvement as set forth in claim 5 wherein the vacuum motor comprises a housing and a flexible diaphragm positioned in the housing, the other end of the link being attached to the diaphragm and one side of the diaphragm being exposed to engine vacuum, the housing having a control orifice therein by which engine vacuum is applied to the one side of the diaphragm and the size of the control orifice being such that the diaphragm is exposed to a change in engine vacuum a period of time after the change occurs.

7. The improvement as set forth in claim 3 wherein the force exerted by the spring on the throttle lever is adjustable thereby the control the engine vacuum level below which the second throttle valve is allowed to open.

* * * * *